US008336598B1

(12) United States Patent
Chang

(10) Patent No.: US 8,336,598 B1
(45) Date of Patent: Dec. 25, 2012

(54) SAFETY DEVICE FOR A ROLLER BLIND

(75) Inventor: Tso-Shn Chang, Taichung (TW)

(73) Assignee: Rising Sun Development Co., Ltd., Taichung (TW)

( * ) Notice: Subject to any disclaimer, the term of this patent is extended or adjusted under 35 U.S.C. 154(b) by 0 days.

(21) Appl. No.: 13/293,924

(22) Filed: Nov. 10, 2011

(51) Int. Cl.
*E06B 9/40* (2006.01)

(52) U.S. Cl. ..... 160/321; 160/323.1; 160/177 V

(58) Field of Classification Search ..... 160/321, 160/177 V, 320, 322, 323.1, 370.22, 903; 248/266, 267, 268, 269
See application file for complete search history.

(56) References Cited

U.S. PATENT DOCUMENTS

| | | | | |
|---|---|---|---|---|
| 6,116,325 | A * | 9/2000 | Colson et al. | 160/321 |
| 6,749,000 | B2 * | 6/2004 | Bohlen | 160/321 |
| 7,380,582 | B1 * | 6/2008 | Anderson et al. | 160/323.1 |
| 7,677,294 | B2 * | 3/2010 | Bohlen | 160/323.1 |
| 8,122,932 | B2 * | 2/2012 | Cannaverde | 160/120 |
| 2012/0193042 | A1 * | 8/2012 | Koop et al. | 160/323.1 |
| 2012/0255686 | A1 * | 10/2012 | Huang | 160/293.1 |

* cited by examiner

*Primary Examiner* — David Purol

(57) ABSTRACT

A safety device for a roller blind comprises: a housing, a cover and a locking member, a drive mechanism and an elastic member that are disposed between the cover and the housing. The locking member is disposed between the drive mechanism and the housing, so that when an excessively big pulling force is applied to the bead chain, the bead chain and the drive mechanism will be automatically disengaged from the driven mechanism. Hence, the security of the safety device for the roller blind is considerably improved.

3 Claims, 7 Drawing Sheets

SAFETY DEVICE FOR A ROLLER BLIND

BACKGROUND OF THE INVENTION

1. Field of the Invention

The present invention relates to a roller blind, and more particularly to a safety device for a roller blind.

2. Description of the Prior Art

A conventional roller blind clutch 10 as shown in FIG. 1 comprises an integrally formed housing 11 sealed with a laminate cover 12. Inside the housing 11 is disposed a motion transmission structure with a driven shaft 13 extending out of the far end of the housing 11 with respect to the cover 12, and the driven shaft 13 is used to connect a roller (not shown) for rolling up the blind. A bead chain 14 is movably connected to the motion transmission structure in the housing 11 and located adjacent to the cover 12. Pulling the bead chain 14 can roll up or roll down the blind.

However, since the bead chain 14 is hung outside the housing 11, some toddlers may wind the bead chain 14 around the neck just for fun or by accident and are likely to choke to death, causing security problems.

The present invention has arisen to mitigate and/or obviate the afore-described disadvantages.

SUMMARY OF THE INVENTION

The primary object of the present invention is to provide a safety device for a roller blind, wherein a locking member is disposed between the drive mechanism and the housing, so that when an excessively big pulling force is applied to the bead chain, the bead chain and the drive mechanism will be automatically disengaged from the driven mechanism. Hence, the security of the safety device for the roller blind is considerably improved.

To achieve the above object, a safety device for a roller blind in accordance with the present invention comprises: a housing, a cover and a locking member, a drive mechanism and an elastic member that are disposed between the cover and the housing.

In the housing is disposed a driven mechanism extending to both ends of the housing, the driven mechanism has one end formed with a polygonal concave, the housing is formed around the concave with an assembling portion which is formed with two slide grooves at two opposite sides thereof, and a locking hole is formed in a periphery of the concave and located between the two slide grooves.

The locking member is assembled on the assembling portion of the housing and formed with an assembling hole to be aligned with the concave, around an inner surface of the assembling hole of the locking member is formed a flange which is located adjacent to the housing. The locking member is formed with two slide blocks at two opposite sides of the assembling hole, and a locking block to be engaged in the locking hole. The locking block includes a locking portion extending toward the locking hole. Around the assembling hole and adjacent the locking block is formed an assembling block, and around the assembling hole and opposite to the assembling block is formed a connecting block. The two slide blocks are received in the slide grooves, and the locking portion of the locking block is engaged with the locking hole.

The drive mechanism includes a driven member, a bead chain and a drive member. The driven member is a cylindrical structure received in the assembling hole and abutted against the flange. The driven member is formed with a through hole to be aligned with the assembling hole. In an inner surface of the through hole are formed three spaced locking grooves, and around an outer surface of the driven member are formed a stop flange and a plurality of bead grooves equidistantly formed around the stop flange. The bead chain includes a plurality of beads connected together and is hung to the driven member in such a manner the beads are engaged in the bead grooves. The drive member is a hollow cylindrical structure received in the through hole and has one end formed with a polygonal conical protrusion inserted through the assembling hole and into the concave of the housing and has another end formed with a chamber. The drive member is formed around its outer surface with three ribs to be engaged with the locking grooves of the through hole.

The elastic member is received in the chamber of the drive member.

The cover is formed with a positioning concave and fixed to the assembling block and the connecting block of the locking member, and the elastic member is received between the chamber of the drive member and the positioning concave.

DETAILED DESCRIPTION OF THE PREFERRED EMBODIMENTS

Figure 1:
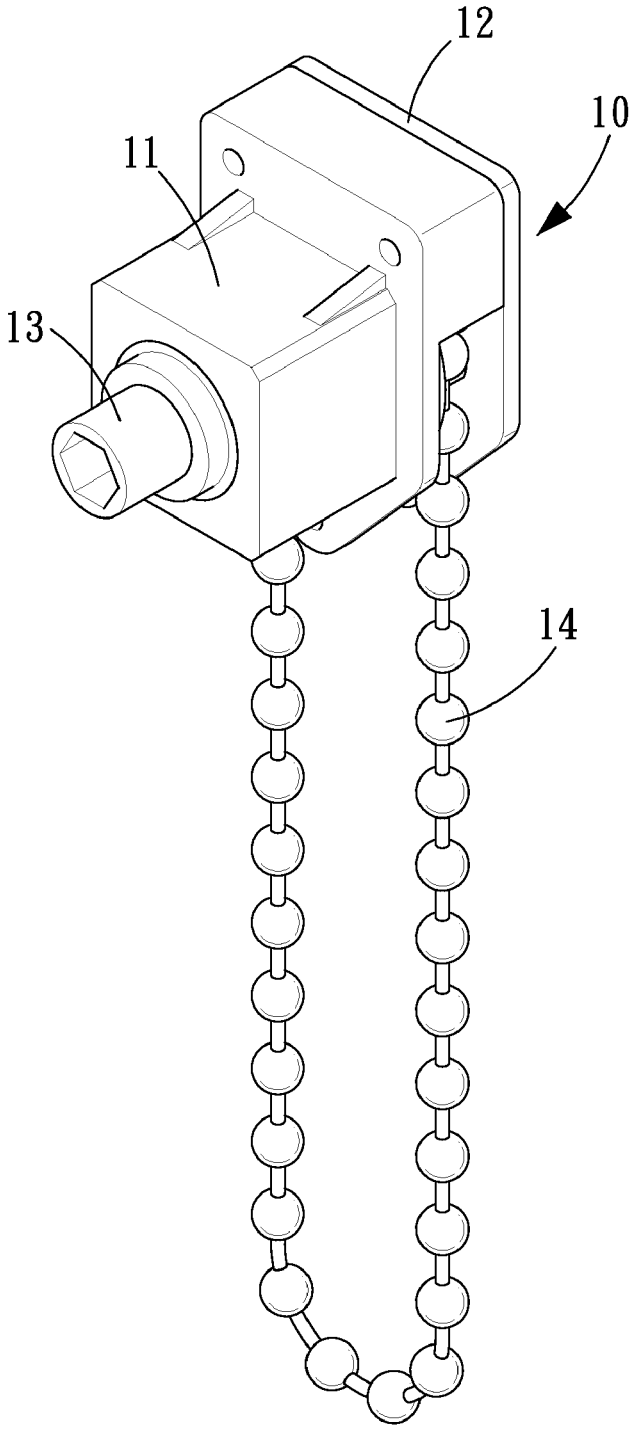
FIG. 1 PRIOR ART
FIG. 1 a perspective view of a conventional rolling device for a roller blind.
Figure 2:
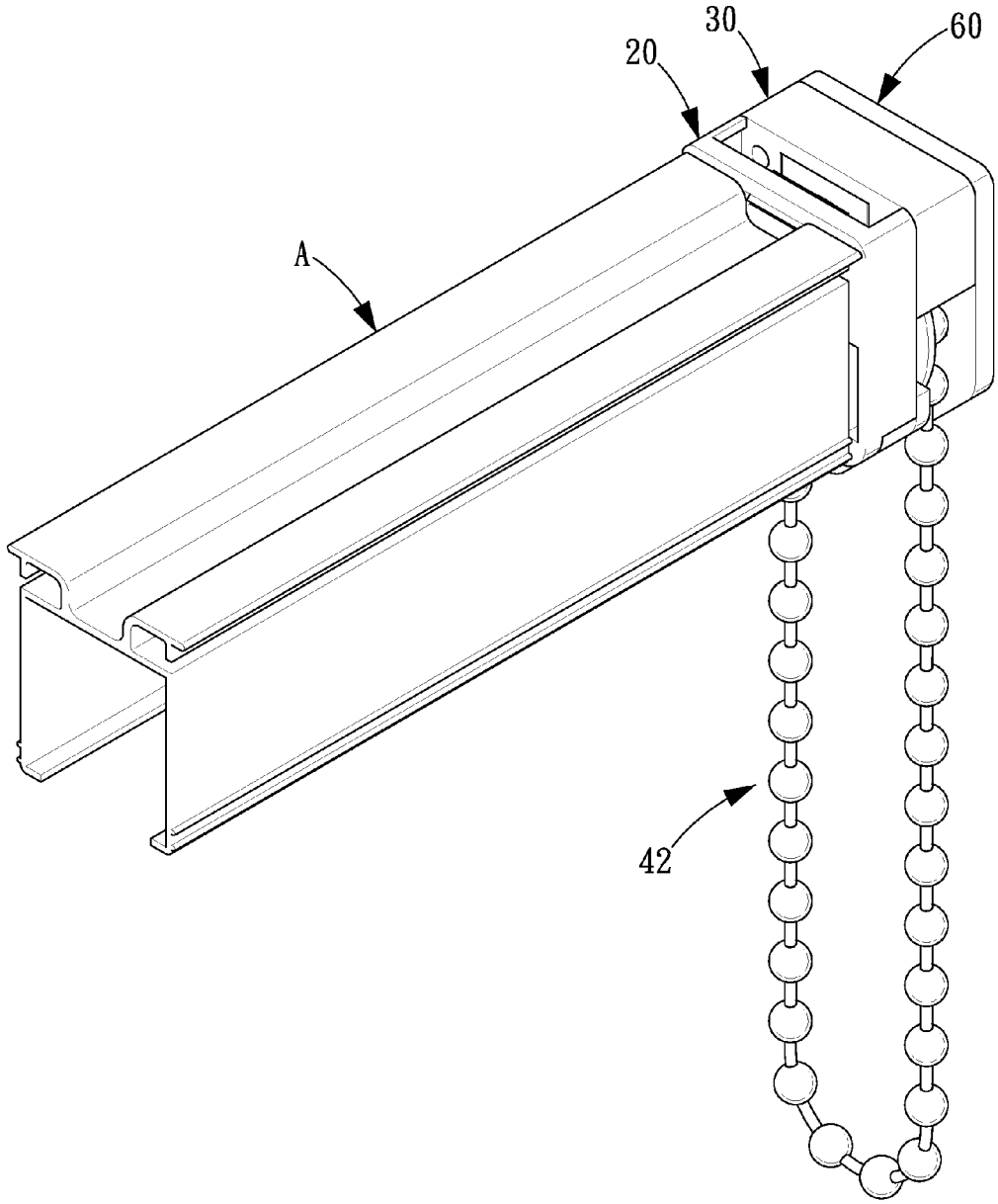
FIG. 2 shows rolling blind device in accordance with the present invention.

The present invention will be clearer from the following description when viewed together with the accompanying drawings, which show, for purpose of illustrations only, the preferred embodiment in accordance with the present invention.

Referring to FIGS. 2-5, a safety device for roller blind in accordance with a preferred embodiment of the present invention is disposed beside a girder A for mounting the window blind and comprises a housing 20, a cover 60 and a locking member 30, a drive mechanism 40 and an elastic member 50 that are disposed between the cover 60 and the housing 20.

The housing 20 is a hollow structure, in which is disposed a driven mechanism 21 extending to both ends of the housing 20, and the driven mechanism 21 has one end received in the housing 20 and formed with a polygonal concave 212. The housing 20 is formed around the concave 212 with an assembling portion 22 which is formed with two slide grooves 221 at two opposite sides thereof, and a locking hole 222 is formed in the periphery of the concave 212 and located between the two slide grooves 221.

Figure 3:
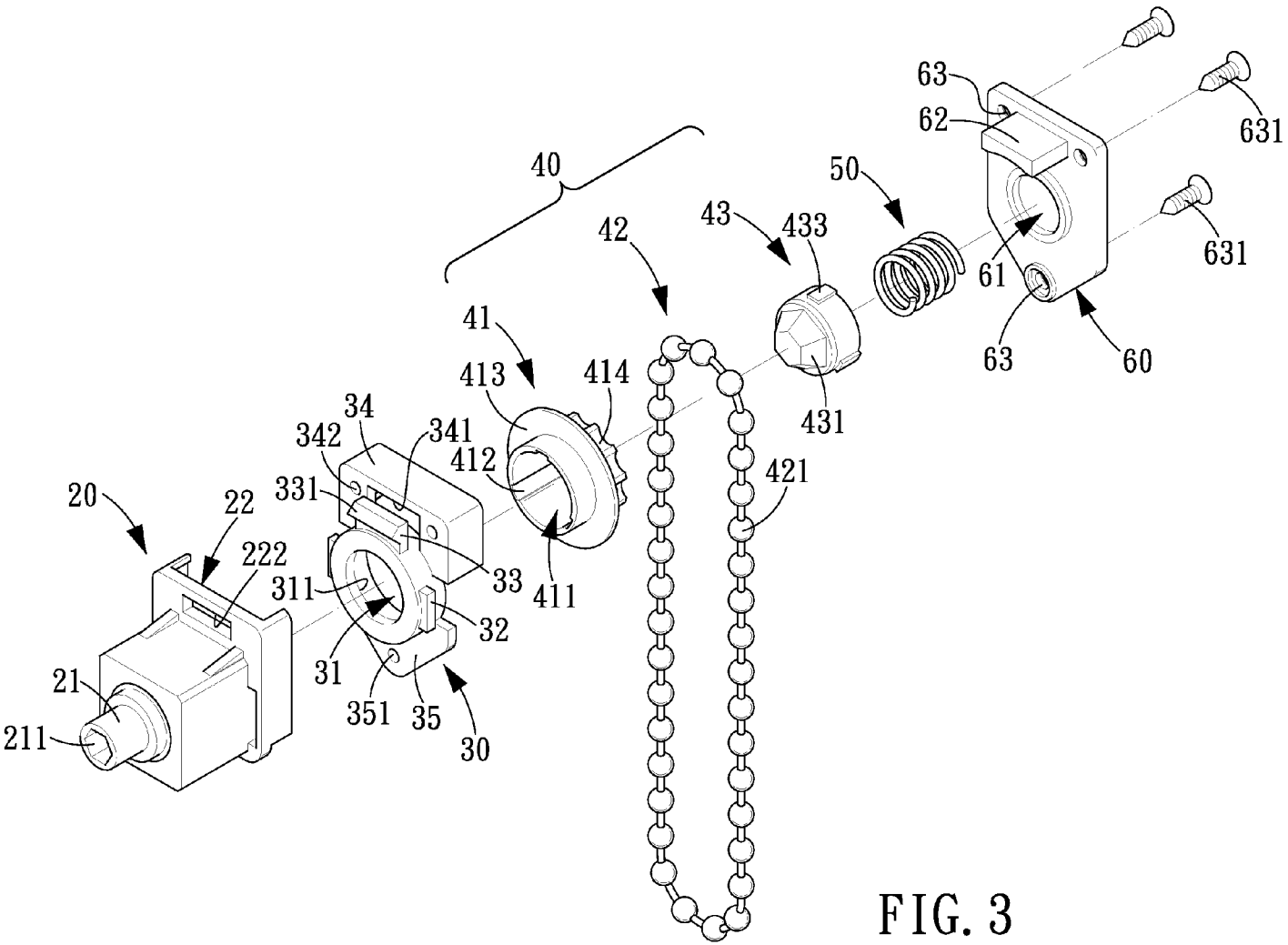
FIG. 3 is an exploded view of a safety device for a roller blind in accordance with the present invention.
Figure 5:
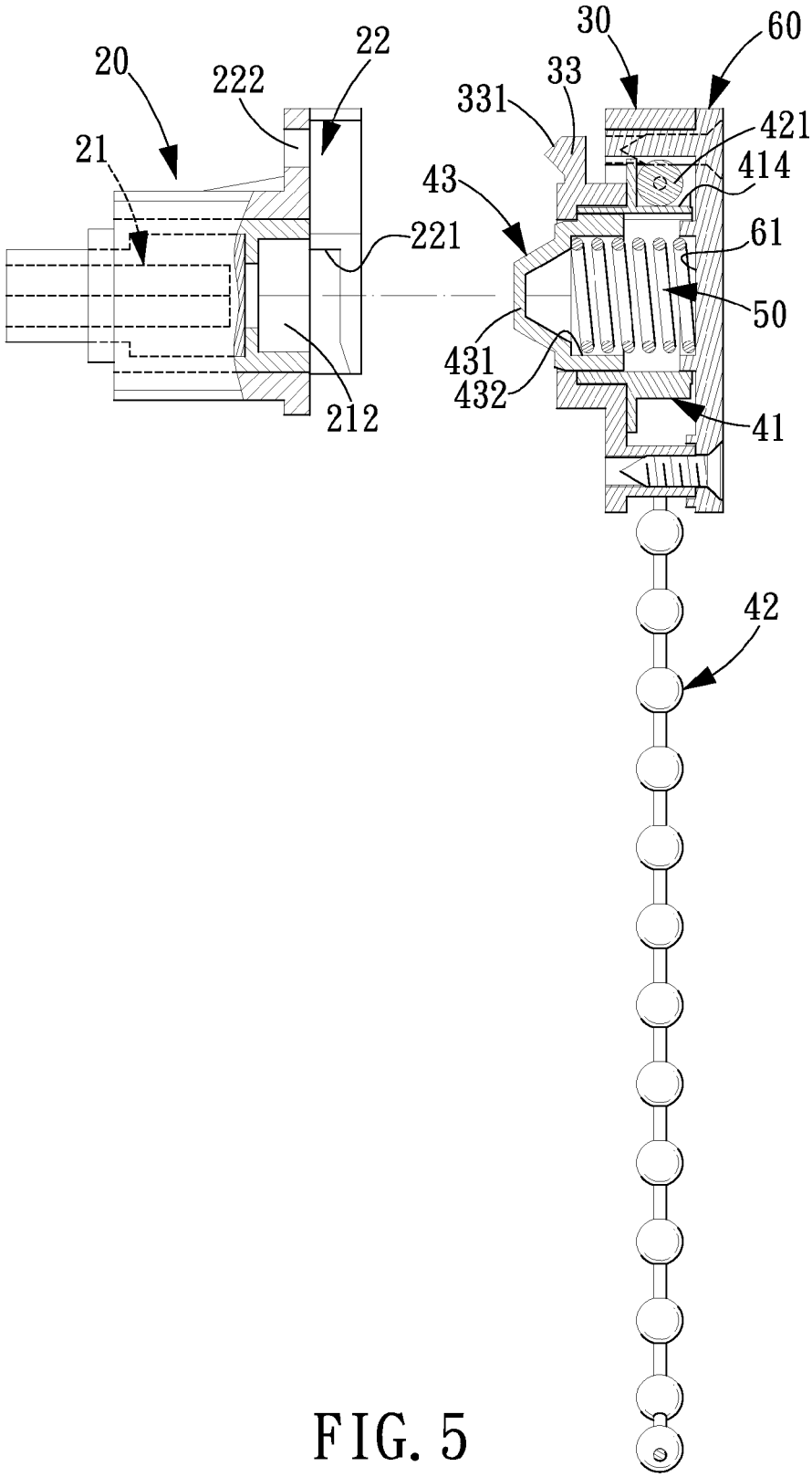
FIG. 5 is an exploded cross sectional view of FIG. 4.

In this embodiment, the concave 212 is hexagonal in cross section. As shown in FIGS. 3 and 5, the driven mechanism 21 has another end extending out of the housing 20 and formed with an inserting portion 211. The inserting portion 211 is a hollow structure formed with a hexagonal hole for insertion of a hexagonal roller (not shown) for rolling up the blind. The driven mechanism 21 drives the inserting portion 211 and the hexagonal roller to rotate through the rotation of the concave 212.

The locking member 30 is assembled on the assembling portion 22 of the housing 20 and formed with an assembling hole 31 to be aligned with the concave 212. Around the inner surface of the assembling hole 31 of the locking member 30 is formed a flange 311 which is located adjacent to the housing 20. The locking member 30 is formed with two slide blocks 32 at two opposite sides of the assembling hole 31, a locking block 33 to be engaged in the locking hole 222, and the locking block 33 includes a locking portion 331 extending toward the locking hole 222. Around the assembling hole 31 and adjacent the locking block 33 is formed an assembling block 34, and around the assembling hole 31 and opposite to the assembling block 34 is formed a connecting block 35. The two slide blocks 32 are received in the slide grooves 221, and the locking portion 331 of the locking block 33 is engaged with the locking hole 222.

In this embodiment, the locking portion 331 includes two inclined surfaces inclined toward the locking hole 222. The assembling block 34 of the locking member 30 is formed with an engaging groove 341 and two engaging holes 342 at both sides of the engaging groove 341. In the connecting block 35 is defined an engaging hole 351.

The drive mechanism 40 includes a driven member 41, a bead chain 42 and a drive member 43. The driven member 41 is hollow cylinder structure received in the assembling hole 31 and abutted against the flange 311. The driven member 41 is formed with a through hole 411 to be aligned with the assembling hole 31, in the inner surface of the through hole 411 are formed three spaced locking grooves 412, and around the outer surface of the driven member 41 are formed a stop flange 413 and a plurality of bead grooves 414 equidistantly formed around the stop flange 413.

The bead chain 42 includes a plurality of beads 421 connected together is hung to the driven member 41 in such a manner the beads 421 are engaged in the bead grooves 414. The drive member 43 is a hollow cylindrical structure received in the through hole 411 and has one end formed with a polygonal conical protrusion 431 inserted through the assembling hole 31 and into the concave 212 of the housing 20 and has another end formed with a chamber 432. The drive member 43 is formed around its outer surface with three ribs 433 to be engaged with the locking grooves 412 of the through hole 411. In this embodiment, the polygonal conical protrusion 431 is hexagonal conical.

The elastic member 50 has one end received in the chamber 432 of the drive member 43 and is a helical spring in this embodiment.

The cover 60 is formed to fit the contour of the locking member 30 and is formed in the center thereof with a positioning concave 61. The cover 60 is fixed to the assembling block 34 and the connecting block 35 of the locking member 30, and the elastic member 50 is received between the chamber 432 of the drive member 43 and the positioning concave 61.

In this embodiment, the cover 60 is formed with an inserting block 62 to be inserted in the engaging groove 341 of the locking member 30 and is further formed with three engaging holes 63 to be aligned with the engaging holes 342, 351 of the locking member 30, respectively. The cover 60 is fixed to the locking member 30 in such a manner that the inserting block 62 is inserted in the engaging groove 341, and then three fasteners 631 are inserted through the engaging holes 63 of the cover 60 and into the engaging holes 342, 351 of the locking member 30, respectively.

Referring to FIGS. 5-7 again for a better understanding of the operation and function of the present invention, pulling the bead chain 42 can rotate the driven member 41 and the drive member 43 inside the driven member 41, consequently driving the concave 212 of the driven mechanism 21 of the housing 20 that engages with the conical protrusion 431 of the drive member 43 to rotate, and thus the driven mechanism 21 is caused to rotate to roll up the blind. As shown in FIG. 5, the locking member 30 is disposed between the drive mechanism 40 and the housing 20, and the conical protrusion 431 of the drive member 43 is pushed out of the assembling hole 31 by the elastic member 50.

Figure 4:
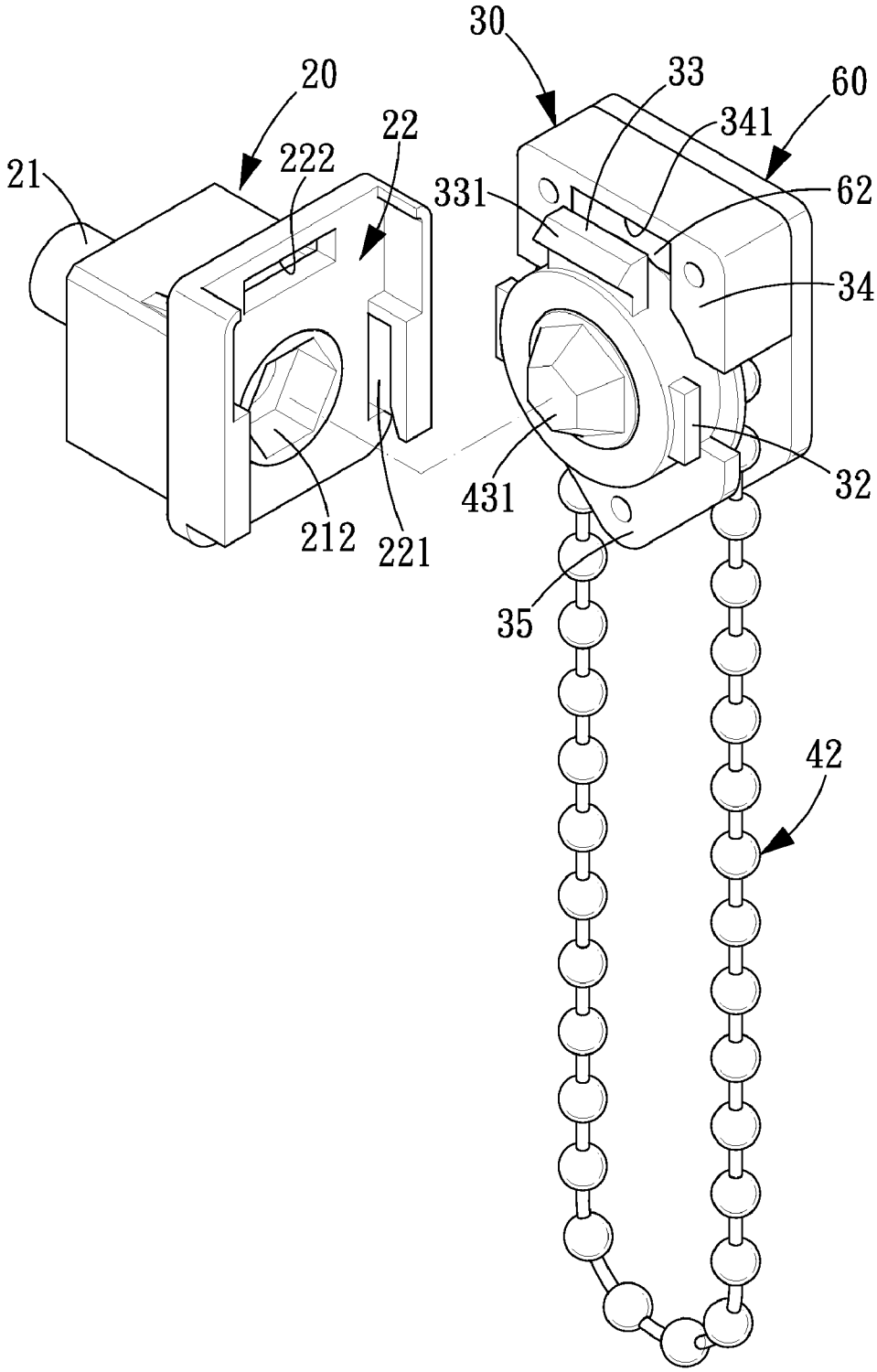
FIG. 4 is a partial exploded view of the safety device for a roller blind in accordance with the present invention.
Figure 6:
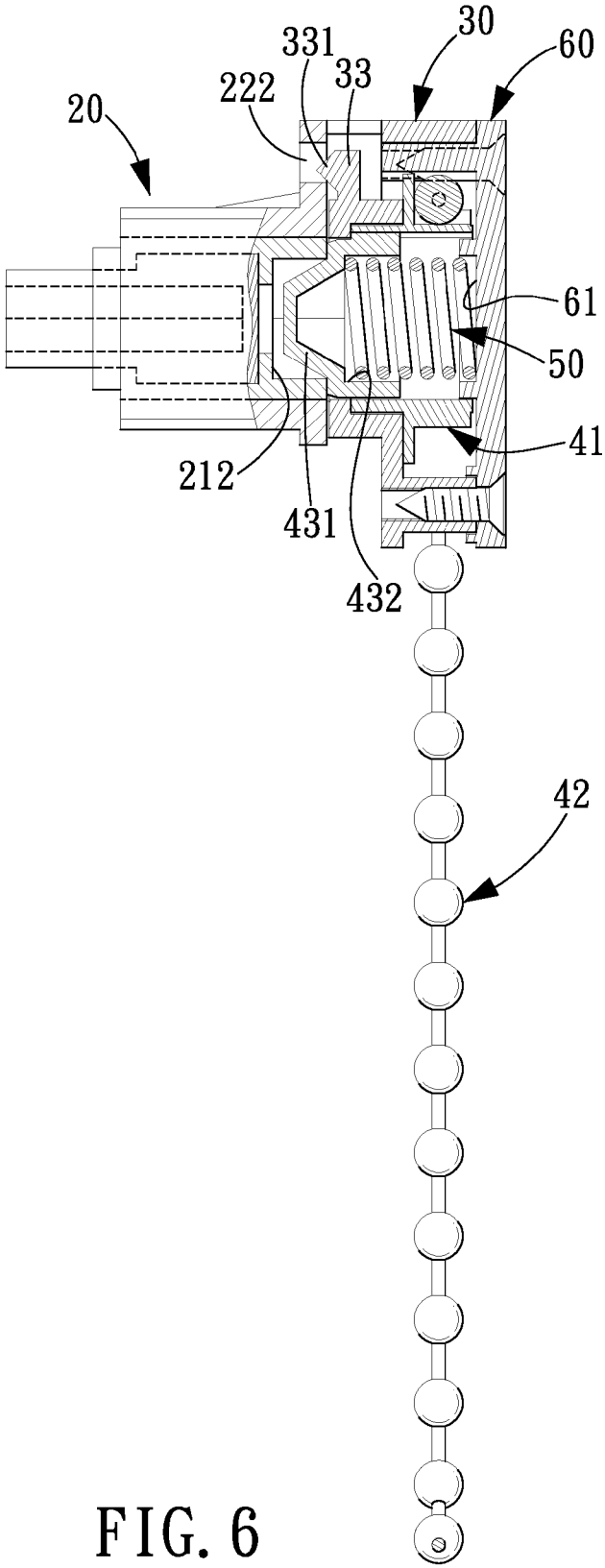
FIG. 6 is an assembly cross sectional view of FIG. 4.

As show in FIGS. 4 and 6, with the elastic deformable force of the locking block 33, and the elastic force applied to the drive member 43 by the elastic member 50, the locking member 30 can be automatically assembled onto the housing 20 simply by sliding the two slide blocks 32 along the two slide grooves 221 to a position where the assembling hole 31 is aligned with the housing 20, the locking block 33 will be engaged in the locking hole 222, and the conical protrusion 431 of the drive member 43 will be pushed into the concave 212 by the elastic member 50. Hence, in normal conditions, when the user rolls up the blind by pulling the bead chain 42, the elastic deformation force of the locking block 33 and the elastic force applied to the drive member 43 will be larger than the pulling force applied to the bead chain 42. At this moment, the locking member 30 and the drive member 43 won't be disengaged form the housing 20.

Figure 7:
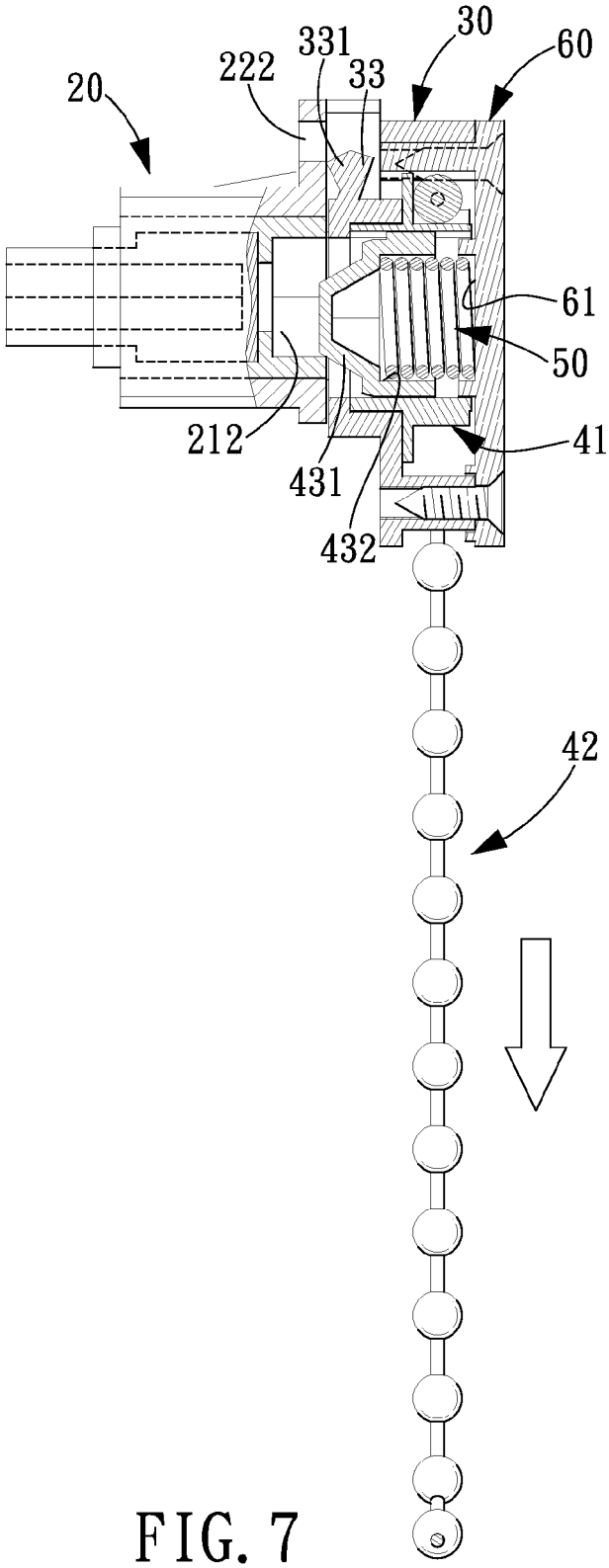
FIG. 7 is a cross sectional view of the safety device for a roller blind in accordance with the present invention.

As shown in FIG. 7, when the bead chain 42 is subjected to a force (such as a pulling force generated when a toddler's neck is wrapped by the bead chain 42 and the toddler struggles to get off the bead chain), the force will be greater than the sum of the elastic deformation force of the locking block 33 and the elastic force applied to the drive member 43. As a result, the locking block 33 will deform to make the locking portion 331 of the locking block 33 disengage from the locking hole 222. At this moment, the conical protrusion 431 will move a little back away from the concave 212 and its conical surface will be abutted against the periphery of the concave 212. Finally, the concave 212 shrinks to push the conical protrusion 431 back into the assembling hole 31, and consequently, the locking member 30 and the drive member 43 will be disengaged form the housing 20. Hence, the security of the safety device for the roller blind is considerably improved.

While we have shown and described various embodiments in accordance with the present invention, it is clear to those skilled in the art that further embodiments may be made without departing from the scope of the present invention.

What is claimed is:

1. A safety device for a roller blind comprising:

a housing in which being disposed a driven mechanism extending to both ends of the housing, the driven mechanism having one end formed with a polygonal concave, the housing being formed around the concave with an assembling portion which is formed with two slide grooves at two opposite sides thereof, and a locking hole being formed in a periphery of the concave and located between the two slide grooves;

a locking member assembled on the assembling portion of the housing and formed with an assembling hole to be aligned with the concave, around an inner surface of the assembling hole of the locking member being formed a flange which is located adjacent to the housing, the locking member being formed with two slide blocks at two opposite sides of the assembling hole, a locking block to be engaged in the locking hole, and the locking block including a locking portion extending toward the locking hole, around the assembling hole and adjacent the locking block being formed an assembling block, and around the assembling hole and opposite to the assembling block being formed a connecting block, the two slide blocks being received in the slide grooves, and the locking portion of the locking block being engaged with the locking hole;

a drive mechanism including a driven member, a bead chain and a drive member, the driven member being a cylindrical structure received in the assembling hole and abutted against the flange, the driven member being formed with a through hole to be aligned with the assembling hole, in an inner surface of the through hole being formed three spaced locking grooves, and around an outer surface of the driven member being formed a stop flange and a plurality of bead grooves equidistantly formed around the stop flange, the bead chain including a plurality of beads connected together and being hung to the driven member in such a manner the beads are engaged in the bead grooves, the drive member being a hollow cylindrical structure received in the through hole and having one end formed with a polygonal conical protrusion inserted through the assembling hole and into the concave of the housing and having another end formed with a chamber, the drive member being formed around its outer surface with three ribs to be engaged with the locking grooves of the through hole;

an elastic member received in the chamber of the drive member; and a cover formed with a positioning concave and fixed to the assembling block and the connecting block of the locking member, and the elastic member being received between the chamber of the drive member and the positioning concave.

2. The safety device for a roller blind as claimed in claim 1, wherein the assembling block of the locking member is formed with an engaging groove and two engaging holes at both sides of the engaging groove, in the connecting block is defined an engaging hole, the cover is formed with an inserting block to be inserted in the engaging groove of the locking member and is further formed with three engaging holes to be aligned with the engaging holes of the locking member, respectively, and the cover is fixed to the locking member in such a manner that the inserting block is inserted in the engaging groove, and then three fasteners are inserted through the engaging holes of the cover and into the engaging holes of the locking member, respectively.

3. The safety device for a roller blind as claimed in claim 1, wherein the driven mechanism has another end extending out of the housing and formed with an inserting portion, the inserting portion is a hollow structure formed with a hexagonal hole for insertion of a hexagonal roller, the driven mechanism drives the inserting portion and the hexagonal roller to rotate through rotation of the concave.

* * * * *